US010615557B2

(12) United States Patent
Weber et al.

(10) Patent No.: US 10,615,557 B2
(45) Date of Patent: Apr. 7, 2020

(54) 4-WAY INDENT TOOL

(71) Applicant: TE CONNECTIVITY CORPORATION, Berwyn, PA (US)

(72) Inventors: Tyler Benjamin Weber, Manheim, PA (US); Richard Lloyd Schaeffer, Carlisle, PA (US)

(73) Assignee: TE Connectivity Corporation, Berwyn, PA (US)

( * ) Notice: Subject to any disclaimer, the term of this patent is extended or adjusted under 35 U.S.C. 154(b) by 300 days.

(21) Appl. No.: 15/832,135

(22) Filed: Dec. 5, 2017

(65) Prior Publication Data

US 2019/0173252 A1 Jun. 6, 2019

(51) Int. Cl.
*H01R 43/042* (2006.01)
*H01R 43/048* (2006.01)

(52) U.S. Cl.
CPC ..... *H01R 43/0428* (2013.01); *H01R 43/0424* (2013.01); *H01R 43/0486* (2013.01); *H01R 43/0488* (2013.01)

(58) Field of Classification Search
CPC ..... H01R 43/0424; H01R 43/0428; H01R 43/0486; H01R 43/0488
See application file for complete search history.

(56) References Cited

U.S. PATENT DOCUMENTS 3,094,702 A * 6/1963 Haucke ..... H01R 43/042 72/402
3,199,334 A 8/1965 Holmes et al.
3,199,335 A * 8/1965 Holmes ..... H01R 43/0424 72/409.01
3,226,968 A * 1/1966 Holmes ..... H01R 43/0424 72/402
3,459,029 A * 8/1969 Rosenfeld ..... H01R 43/0424 72/402
3,750,618 A * 8/1973 Griebenow ..... B23B 29/03 116/231
4,774,762 A 10/1988 Gobeil
5,490,801 A 2/1996 Fisher, Jr. et al.
5,657,417 A 8/1997 Di Troia
5,727,417 A 3/1998 Moffatt et al.
6,138,346 A 10/2000 Shutts et al.
6,807,840 B2 * 10/2004 Wilhelm ..... B25B 27/146 72/402

(Continued)

FOREIGN PATENT DOCUMENTS

SE 102014100348 A1 1/2015

*Primary Examiner* — Carl J Arbes

(57) ABSTRACT

A 4-way indent tool includes a cover holding a motor and a drive screw operably coupled to the motor and an indenter holder holding four indenters positioned orthogonally around a terminal opening configured to receive a terminal. The 4-way indent tool includes a indenter actuator cam arm positioned adjacent the indenter holder to operably engage the indenters having cam surfaces engaging the corresponding indenters to actuate the indenters. The 4-way indent tool includes a drive nut threadably coupled to the drive screw being moved linearly on the drive screw between an unactuated position and an actuated position. The indenter actuator cam arm is coupled to the drive nut and moves with the drive nut between the unactuated position and the actuated position to actuate the indenters.

20 Claims, 6 Drawing Sheets

(56) References Cited

U.S. PATENT DOCUMENTS

| | | | | |
|---|---|---|---|---|
| 7,254,982 | B2 | 8/2007 | Frenken | |
| D767,959 | S | 10/2016 | Sokat et al. | |
| 2008/0276678 | A1* | 11/2008 | Pacaud ..... | B25B 27/10 72/21.4 |
| 2010/0314226 | A1 | 12/2010 | Patel et al. | |

* cited by examiner

4-WAY INDENT TOOL

BACKGROUND OF THE INVENTION

The subject matter herein relates generally to a 4-way indent tool.

Tools are used to attach terminals to ends of wires. For example, crimp tools are known for crimping the terminal to the wire. Some tools, known as 4-way indent tools, provide four indenters arranged at orthogonal positions that are driven into the terminal to crimp the terminal in four different positions. Some conventional 4-way indent tools are hand powered, which may lead to inconsistent crimps and operator fatigue. Other known 4-way indent tools are hydraulic or pneumatic powered. However, the hydraulic tools are heavy and may be difficult to use. The pneumatic tools must be connected to an air hose, and are thus limited in their use.

A need remains for a light-weight tool providing flexibility in use having repeatable and reliable operation.

BRIEF DESCRIPTION OF THE INVENTION

In one embodiment, a 4-way indent tool is provided including a cover having a base and a head. The base holds a motor driven by a power source. The cover holds a drive screw operably coupled to the motor and being rotated by the motor when the motor is operated. The 4-way indent tool includes an indenter holder at the head holding four indenters positioned orthogonally around a terminal opening configured to receive a terminal. The indenters are actuated to move relative to the terminal opening to crimp the terminal received in the terminal opening. The 4-way indent tool includes a indenter actuator cam arm positioned adjacent the indenter holder to operably engage the indenters. The indenter actuator cam arm has cam surfaces engaging the corresponding indenters to actuate the indenters. The indenter actuator cam arm has a cam lever arm. The 4-way indent tool includes a drive nut threadably coupled to the drive screw. The drive nut is moved linearly on the drive screw between an unactuated position and an actuated position. The indenter actuator cam arm is coupled to the drive nut and moves with the drive nut between the unactuated position and the actuated position to actuate the indenters.

In another embodiment, a 4-way indent tool is provided including a cover having a base and a head. The base holds a motor driven by a power source. The cover holds a drive screw operably coupled to the motor and being rotated by the motor when the motor is operated. The 4-way indent tool includes a crimp height adjustment mechanism variably positionable relative to the head. The 4-way indent tool includes an indenter holder at the head holding four indenters positioned orthogonally around a terminal opening configured to receive a terminal. The indenters are actuated to move relative to the terminal opening to crimp the terminal received in the terminal opening. The 4-way indent tool includes a indenter actuator cam arm positioned adjacent the indenter holder to operably engage the indenters. The indenter actuator cam arm has cam surfaces engaging the corresponding indenters to actuate the indenters. The indenter actuator cam arm has a cam lever arm. The 4-way indent tool includes a drive nut threadably coupled to the drive screw. The drive nut is moved linearly on the drive screw between an unactuated position and an actuated position. The indenter actuator cam arm is coupled to the drive nut and moves with the drive nut between the unactuated position and the actuated position to actuate the indenters. The drive nut bottoms out against the crimp height adjustment mechanism in the actuated position. The actuated position is variable and controlled by the position of the crimp height adjustment mechanism.

In a further embodiment, a 4-way indent tool is provided including a cover having a base and a head. The base holds a motor driven by a power source. The cover holds a drive screw operably coupled to the motor and being rotated by the motor when the motor is operated. The 4-way indent tool includes a crimp height adjustment mechanism variably positionable relative to the head. The 4-way indent tool includes an indenter holder at the head holding four indenters positioned orthogonally around a terminal opening configured to receive a terminal. The indenters are actuated to move relative to the terminal opening to crimp the terminal received in the terminal opening. The 4-way indent tool includes a indenter actuator cam arm positioned adjacent the indenter holder to operably engage the indenters. The indenter actuator cam arm has cam surfaces engaging the corresponding indenters to actuate the indenters. The indenter actuator cam arm has a cam lever arm. The 4-way indent tool includes a drive nut threadably coupled to the drive screw. The drive nut is moved linearly on the drive screw between an unactuated position and an actuated position. The indenter actuator cam arm is coupled to the drive nut and moves with the drive nut between the unactuated position and the actuated position to actuate the indenters. The drive nut bottoms out against the crimp height adjustment mechanism in the actuated position. The actuated position is variable and controlled by the position of the crimp height adjustment mechanism. The 4-way indent tool includes a limit switch at the head being operably coupled to the motor to switch an operation of the motor. The limit switch is positioned adjacent the crimp height adjustment mechanism. The crimp height adjustment mechanism is forced into the limit switch when the drive nut bottoms out against the crimp height adjustment mechanism to activate the limit switch.

DETAILED DESCRIPTION OF THE INVENTION

Figure 1:
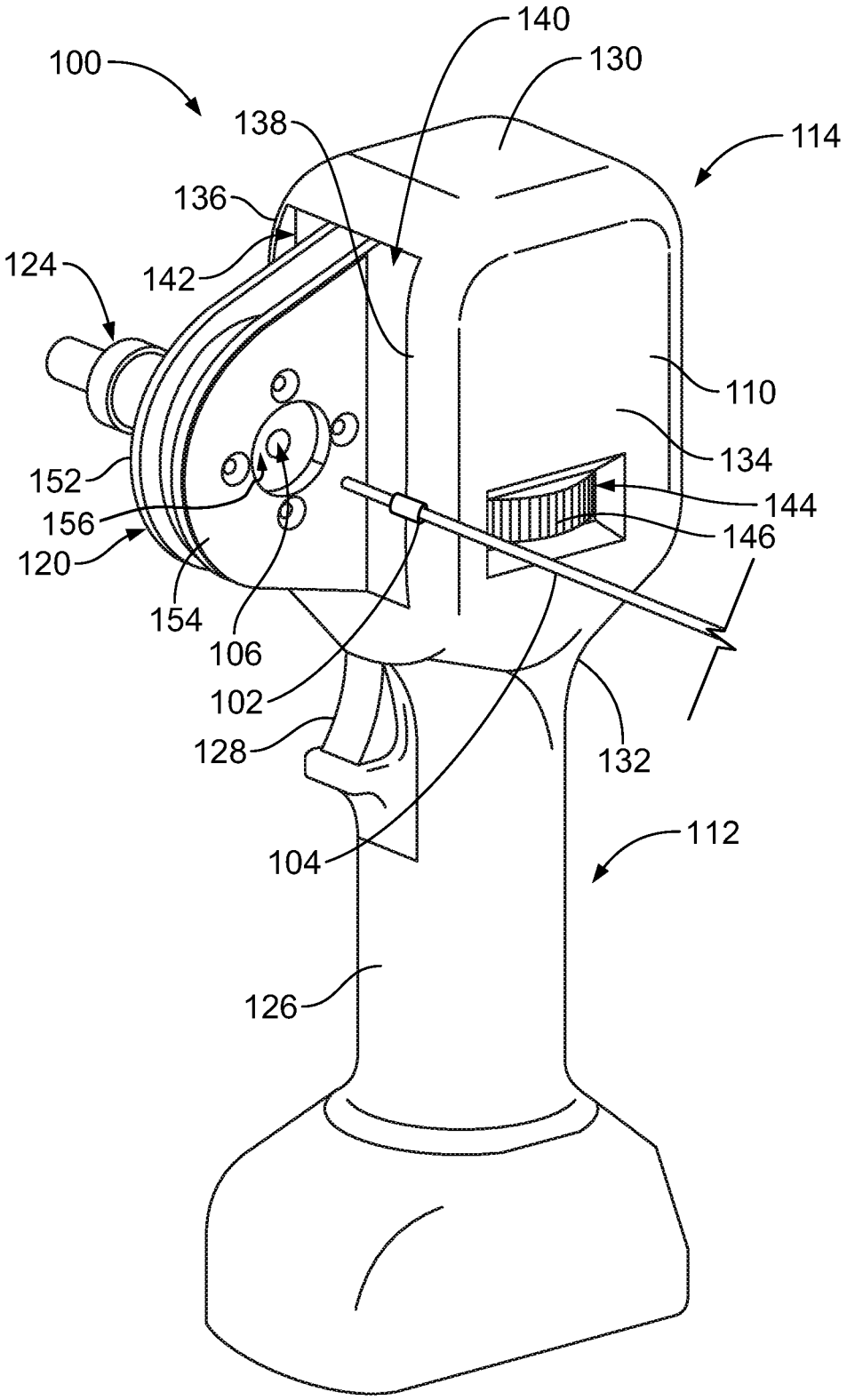
FIG. 1 is a perspective view of a 4-way indent tool in accordance with an exemplary embodiment.
Figure 2:
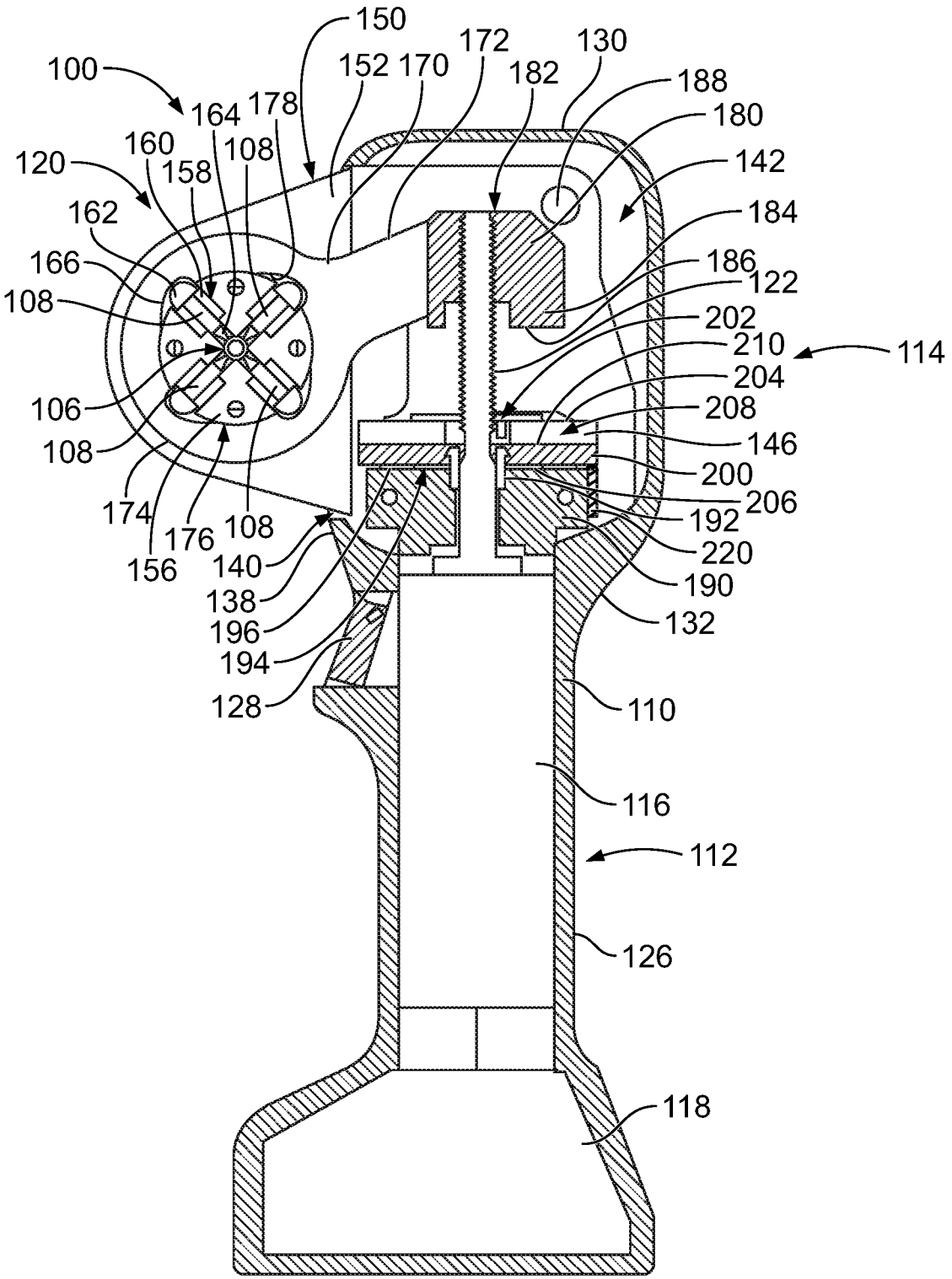
FIG. 2 is a partial sectional view of the 4-way indent tool in accordance with an exemplary embodiment.

FIG. 1 is a perspective view of a 4-way indent tool 100 in accordance with an exemplary embodiment. FIG. 2 is a partial sectional view of the 4-way indent tool 100 in accordance with an exemplary embodiment. In an exemplary embodiment, the 4-way indent tool 100 is used to crimp a terminal 102 to a wire 104. The terminal 102 and the wire 104 are loaded into a terminal opening 106 in the 4-way indent tool 100 and the 4-way indent tool 100 is operated to actuate four indenters 108 (FIG. 2) to crimp the terminal 102 to the wire 104 at four orthogonal locations around the terminal 102. In an exemplary embodiment, the 4-way indent tool 100 is battery operated. In an exemplary embodiment, the 4-way indent tool 100 has a mechanical drive for driving the indenters 108.

The 4-way indent tool 100 includes a tool body or cover 110 having a base 112 and a head 114. The base 112 holds a motor 116 (FIG. 2), such as an electric motor, driven by a power source 118 (FIG. 2), such as a battery. In various embodiments, the motor 116 includes a gearbox. The head 114 holds an indenter assembly 120 including the indenters 108. The head 114 holds a drive screw 122 (FIG. 2) operably coupled to the motor 116 and being rotated by the motor 116 when the motor 116 is operated to drive the indenter assembly 120 and actuate the indenters 108.

The indenter assembly 120 includes the terminal opening 106 configured to receive the terminal 102. The indenter assembly 120 includes a terminal locator 124 aligned with the terminal opening 106 for locating the terminal 102 and the terminal opening 106. In an exemplary embodiment, the terminal locator 124 is adjustable to adjust the position of the terminal 102 and the terminal opening 106 (for example, to control a depth of receipt of the terminal 102 in the terminal opening 106).

The base 112 of the cover 110 includes a handle 126 configured to be held by the operator. The base 112 of the cover 110 includes a trigger 128 for operating the 4-way indent tool 100. The trigger 128 is operably coupled to the motor 116 to drive the motor 116. Optionally, the trigger 128 may have a forward drive and a reverse drive for the motor 116. The 4-way indent tool 100 includes a control system for controlling operation of the motor 116, such as to control a direction of the motor 116, a speed of the motor 116, an operating time or distance of the motor 116 (such as to control a number of revolutions of the motor during an advancing or retracting operation), and the like. In the illustrated embodiment, the power source 118 is located at the bottom of the handle 126 to balance the weight of the 4-way indent tool 100 between the power source 118 at the bottom and the head 114 at the top.

Figure 3:
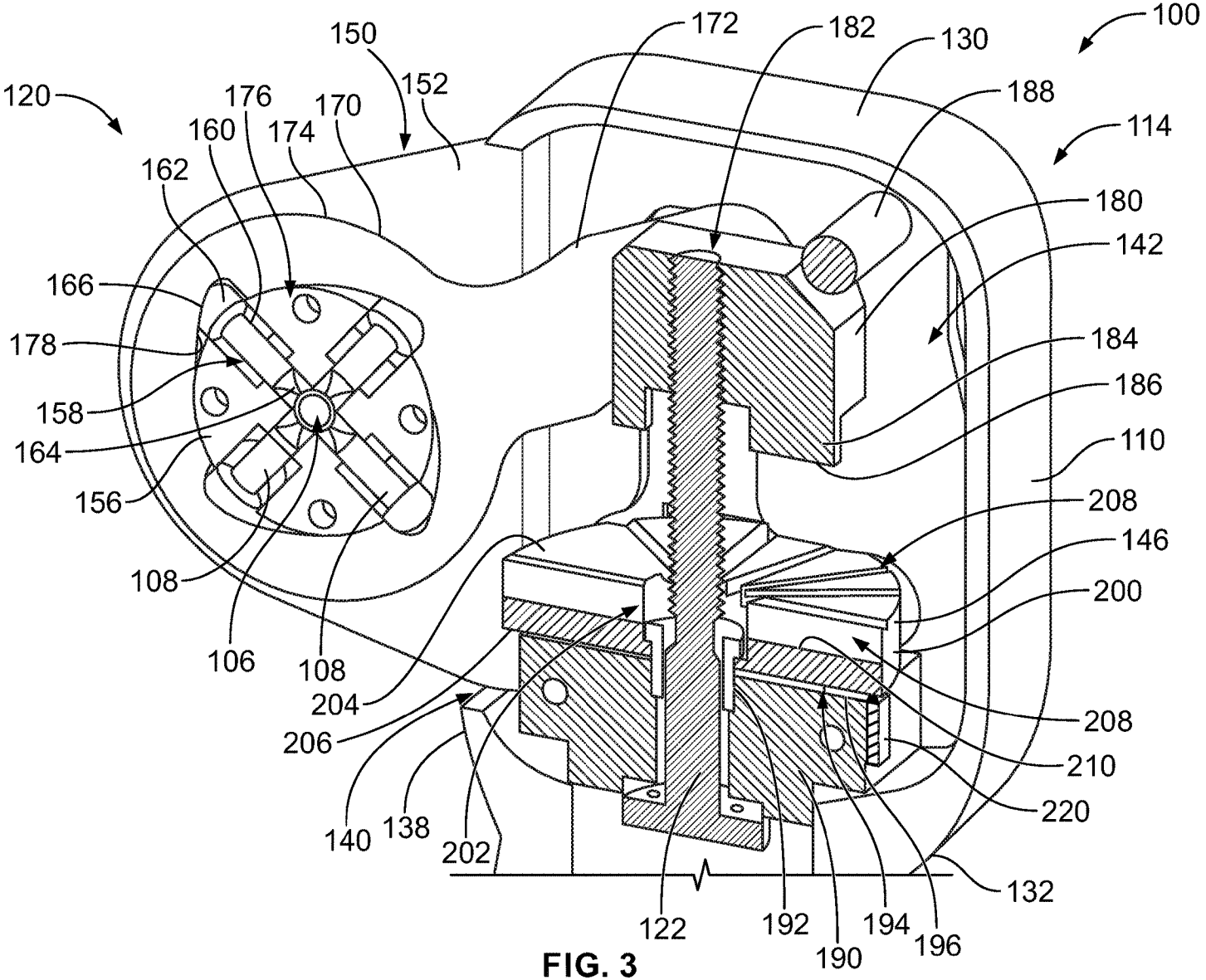
FIG. 3 is a partial sectional, perspective view of a portion of the 4-way indent tool.

With additional reference to FIG. 3, which is a partial sectional, perspective view of a portion of the 4-way indent tool 100, the head 114 extends between a top 130 and a bottom 132. The head 114 has a front 134 and a rear 136. The head 114 includes an open side 138 having an cover opening 140 to a cavity 142. The indenter assembly 120 is positioned in the cavity 142. The indenter assembly 120 extends from the side 138 through the cover opening 140. The cover 110 encloses components of the indenter assembly 120 between the top 130 and the bottom 132 and between the front 134 and the rear 136. In an exemplary embodiment, the head 114 includes a crimp height adjustment access window 144 at the front 134 that provides access to the indenter assembly 120. A crimp height adjustment mechanism 146 is accessible through the window 144. The crimp height adjustment mechanism 146 is adjustable to control a crimp height of the indenters 108 when the 4-way indent tool 100 is operated. In an exemplary embodiment, the crimp height adjustment mechanism 146 may be a disk, a dial, a knob or another type of crimp height adjustment mechanism.

The indenter assembly 120 includes an indenter holder assembly 150 at the head 114 configured to hold the indenters 108. In the illustrated embodiment, the indenter holder assembly 150 includes first and second crimp head side plates 152, 154. The side plates 152, 154 are mounted to the cover 110 within the cavity 142 and extend from the side 138 through the cover opening 140. The side plates 152, 154 define the terminal opening 106. The indenter holder assembly 150 includes an indenter holder 156 between the side plates 152, 154. The indenter holder 156 includes four indenter channels 158 receiving corresponding indenters 108. The indenter channels 158 are arranged at four orthogonal positions to hold the indenters 108 at the orthogonal positions around the terminal opening 106. In an exemplary embodiment, biasing mechanisms 160 are received in the indenter channels 158 and engage the indenters 108 to bias the indenters 108 radially outward away from the terminal opening 106. For example, each biasing mechanism 160 engages a indenter cam 162 of the corresponding indenter 108 to press a indenter tip 164 of the corresponding indenter 108 outward away from the terminal opening 106. The indenter cam 162 includes a indenter cam surface 166 at the radially outer end of the indenter 108 configured to be engaged by the indenter assembly 120 to actuate the indenter 108 during the crimping process.

The 4-way indent tool 100 includes an indenter actuator cam arm 170 positioned adjacent the indenter holder assembly 150 to operably engage the indenters 108. For example, the indenter actuator cam arm 170 is positioned between the first and second side plates 152, 154. The indenter actuator cam arm includes a cam lever arm 172 and an indenter actuator cam head 174 opposite the cam lever arm 172. The cam head 174 includes an indenter holder pocket 176 receiving the indenter holder 156 and the indenters 108. The indenter actuator cam arm 170 includes cam surfaces defined in the indenter holder pocket 176. Each indenter actuator cam surface 178 engages the indenter cam surface 166 of the corresponding indenter 108. As the indenter actuator cam arm 170 is rotated, the cam surfaces 178 drive the indenters 108 radially inward, pressing the indenter tips 164 into the terminal 102 received in the terminal opening 106.

The 4-way indent tool 100 includes a drive nut 180 threadably coupled to the drive screw 122. The cam lever arm 172 is coupled to the drive nut 180 and is movable with the drive nut 180. The drive nut 180 includes a threaded bore 182 extending between a top and a bottom of the drive nut 180 having drive nut threads. The threaded bore 182 is threadably coupled to the drive screw 122. The drive nut 180 is moved linearly on the drive screw 122 as the drive screw 122 is rotated to drive the indenter actuator cam arm 170 to actuate the indenters 108 and then is returned along the drive screw 122 after the terminal 102 is crimped. The drive nut 180 is movable between an unactuated position and an actuated position. For example, the unactuated position may be at or near a top of the drive screw 122 and the actuated position may be at or near a bottom of the drive screw 122. The drive nut 180 is moved downward along the drive screw 122 between the unactuated position and the actuated position. However, in alternative embodiments, the drive nut 180 may be moved upward along the drive screw 122 between the unactuated position and the actuated position. In an exemplary embodiment, the drive nut 180 includes one or more drive nut legs 184 at the bottom thereof. The legs 184 have drive nut bottoming surfaces 186 configured to engage the crimp height adjustment mechanism 146 in the actuated position to control a location or height of the drive nut 180 in the actuated position.

In an exemplary embodiment, the cover 110 includes a crimp head support 188 in the cavity 142 defining a travel stop to limit travel of the drive nut 180. For example, the crimp head support 188 may be positioned above the drive nut 180 to stop upward movement of the drive nut 180 as the drive nut 180 is being returned to the unactuated position after the terminal 102 has been crimped. The crimp head support 188 may be positioned at another location in alternative embodiments. For example, the crimp head support 188 may prevent downward movement of the drive nut 180 in alternative embodiments.

The 4-way indent tool 100 includes a support block 190 at the bottom of the head 114 for supporting the drive screw 122. The drive screw 122 may pass through a bushing 192, such as a press-fit bushing, coupled to the support block 190. The drive screw 122 is rotatable in the bushing 192. In an exemplary embodiment, the crimp height adjustment mechanism 146 is coupled to the support block 190, such as using the bushing 192. Optionally, a floating gap 194 may be provided between the top of the support block 190 and the bottom of the crimp height adjustment mechanism 146. In an exemplary embodiment, a biasing mechanism 196 may be provided in the floating gap 194 to bias the crimp height adjustment mechanism 146 away from the support block 190. For example, the biasing mechanism 196 may be a wave spring, a leaf spring, a coil spring, or another type of biasing mechanism. The crimp height adjustment mechanism 146 floats in the floating gap 194 on the biasing mechanism 196 to change the height of the floating gap 194.

The crimp height adjustment mechanism 146 is variably positionable relative to the head 114. For example, the crimp height adjustment mechanism 146 may be rotated relative to the head 114 to change a crimp height of the indenters 108. For example, the crimp height adjustment mechanism 146 may control a stop height of the drive nut 180 along with the drive screw 122 to control the amount of rotation of the indenter actuator cam arm 170, and thus the distance that the indenters 108 are forced inward into the terminal opening 106. Optionally, a height of the crimp height adjustment mechanism 146 relative to the support block 190 may be adjustable to control the location of the crimp height adjustment mechanism 146, such as by changing the height of the gap 194. Alternatively, the height of the crimp height adjustment mechanism 146 relative to the support block 190 may be fixed, however, the depth of drive of the drive nut 180 relative to the crimp height adjustment mechanism 146 may be varied, such as by rotating the crimp height adjustment mechanism 146.

In an exemplary embodiment, the crimp height adjustment mechanism 146 includes a ring-shaped body 200 having a bore 202 passing therethrough. The drive shaft 122 may pass through the bore 202. The bore 202 may receive the bushing 192 to secure the crimp height adjustment mechanism 146 to the support block 190. The body 200 may be rotatable relative to the bushing 192. The body 200 includes a top 204 and a bottom 206. The gap 194 is provided between the bottom 206 and the support block 190. In an exemplary embodiment, the top 204 includes a plurality of crimp height grooves 208 formed therein. The grooves 208 have different depths from the top 204. The grooves 208 are configured to receive the legs 184 of the drive nut 180. In various embodiments, the bottom 206 of the crimp height adjustment mechanism 146 has grooves or pockets that allow the crimp height adjustment mechanism 146 to be indexed and held in specific radial positions based on the desired crimp height. For example, biasing mechanisms, such as threaded spring pins, fit into the grooves to prevent the body 200 from freely spinning around the bushing 192.

During operation, the drive nut 180 is driven downward along the drive screw 122 such that the legs 184 are received in corresponding grooves 208 in the crimp height adjustment mechanism 146. The bottoming surfaces 186 at the bottom of the legs 184 bottom out against bottoming surfaces 210 of the grooves 208 of the crimp height adjustment mechanism 146. The bottoming surfaces 210 of different grooves 208 are at different vertical heights. The bottoming surfaces 210 of the grooves 208 define the drive limit and drive length of the drive nut 180 along the drive screw 122. When the bottoming surfaces 186 engage the bottoming surfaces 210 of the grooves 208, the drive nut 180 is at the actuated position and is unable to move further down the drive screw 122.

In various embodiments, to change the height of the actuated position, the crimp height adjustment mechanism 146 may be rotated such that a different set of grooves 208 having different depths may be aligned with the legs 184. For example, one set of grooves 208 may be aligned with the legs 184 when the crimp height adjustment mechanism 146 is in a first position, but a different set of grooves 208 may be aligned with the legs 184 when the crimp height adjustment mechanism 146 is in a second position, such grooves 208 being deeper to change the length of the drive stroke of the drive nut 180 along the drive screw 122. A third set of grooves 208 may be aligned with the legs 184 when the crimp height adjustment mechanism 146 is in a third position, such grooves being shallower than the first or second set of grooves to change the length of the drive stroke of the drive nut 180 along the drive screw 122. A longer drive stroke equates to further rotation of the indenter actuator cam arm 170, thus driving the indenters 108 further inward toward each other and the terminal 102. A shorter drive stroke equates to less rotation of the indenter actuator cam arm 170, thus driving the indenters 108 a shorter distance toward the terminal 102.

In an exemplary embodiment, the 4-way indent tool 100 includes a limit switch 220 at the head 114 being operably coupled to the motor 116 to switch an operation of the motor 116 when activated. For example, the limit switch 220 may stop the motor 116, thus stopping rotation of the drive screw 122 and downward movement of the drive nut 180 and/or the limit switch 220 may reverse the motor 116, thus rotating the drive screw 122 in an opposite direction forcing the drive nut 180 upward along the drive screw 122 to the unactuated position. The limit switch 220 may be operably coupled to the control system and the control system may control operation of the motor 116 based on data from or operation of the limit switch 220. In the illustrated embodiment, the limit switch 220 is positioned below the bottom 206 of the crimp height adjustment mechanism 146 such as at the gap 194. The limit switch 220 may be mounted to the support block 190. When the drive nut 180 is driven downward and bottoms out against the crimp height adjustment mechanism 146, the crimp height adjustment mechanism 146 may be driven downward into the limit switch 220 to activate the limit switch 220. For example, the limit switch 220 may include a button or activator at the top of the limit switch 220 that is activated by the crimp height adjustment mechanism bottom out against the activator. The crimp height adjustment mechanism 146 may be driven downward into the support block 190. For example, the biasing mechanism 196 may be compressed by the driving force of the drive nut 180 forcing the crimp height adjustment mechanism 146 into the limit switch 220, then bottoming the crimp height adjustment mechanism 146 on the main support block 190. The crimp height adjustment mechanism 146 may float (for example, vertically) above the biasing mechanism and compress against the biasing mechanism 196 when the drive nut 180 bottoms out against the top 204. The limit switch 220 may be provided at other positions in alternative embodiments. For example, the limit switch 220 may be positioned below the drive nut 180 and the drive nut 180 may be driven directly into the limit switch 220 to activate the limit switch 220.

In various embodiments, the control system of the 4-way indent tool 100 may include a sensor, such as a current sensor configured to sense a current consumption of the motor, such as to determine the status of the overall system. The sensor may sense a current spike or high current reading during the crimp cycle, such as when the drive nut 180 and the crimp height adjustment mechanism 146 are bottomed out against the support block 190. The increase in the current reading may be used as verification of competition of the crimp, such as when the current increase occurs when expected, such as after the limit switch 220 has been activated. However, an increase in the current reading that is incongruent with normal operation occurring at another point of the crimp cycle, such as prior to activation of the limit switch 220, may indicate that an error or fault has occurred and the 4-way indent tool 100 may enter an error mode, such as cease operation until manually reset. The error may be indicative of a jam of the tool, an incorrect or faulty crimp, and the like. The control system may stop the operation or enter an error mode and notify the operator that the tool is jammed or there is another type of error condition. Optionally, the control system may include limit switches, a motor encoder, a timing mechanism or another type of mechanism to determine the position of the drive nut, the length of the stroke, how far to return the drive nut to return the tool to the unactuated position after completing a crimp cycle or error reading, and the like. Operation of the motor may be controlled based on readings from such mechanisms. The control system may include a crimp force monitoring module to monitor the crimping force, such as through a strain gauge, a piezo sensor, a current sensor, and the like.

In an exemplary embodiment, the control system may include a certified crimp feature to ensure that the 4-way indent tool 100 completes the entire crimp cycle or will provide an error message to the operator if unable to complete the crimp cycle before a new crimp can be made. Such certified crimp feature allows the operator to ensure that high quality, precision crimps are produced by the 4-way indent tool 100 and allows the 4-way indent tool 100 to indicate to the operator when a faulty crimp occurs so such crimp can be discarded. Optionally, the 4-way indent tool 100 may include a communication module for wireless communication with a wireless network or other device, such as through wifi, Bluetooth, GPs, cellular communication, and the like to transmit and/or receive data. For example, the 4-way indent tool 100 may transmit data relating to the crimps to a database, such as position, time, cycle count, and the like. The 4-way indent tool 100 may receive set-up and/or crimping parameters (for example, length of crimp stroke, crimp force, terminal type, wire type, and the like).

Figure 4:
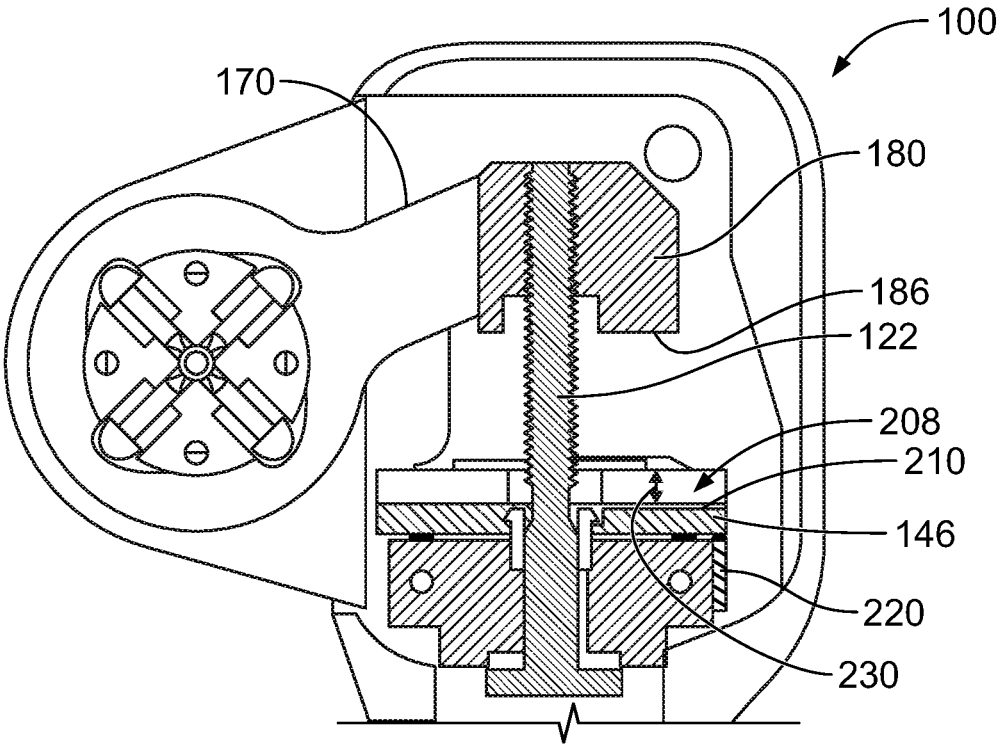
FIG. 4 is a side, partial sectional view of a portion of the 4-way indent tool showing a drive nut in an unactuated position.
Figure 5:
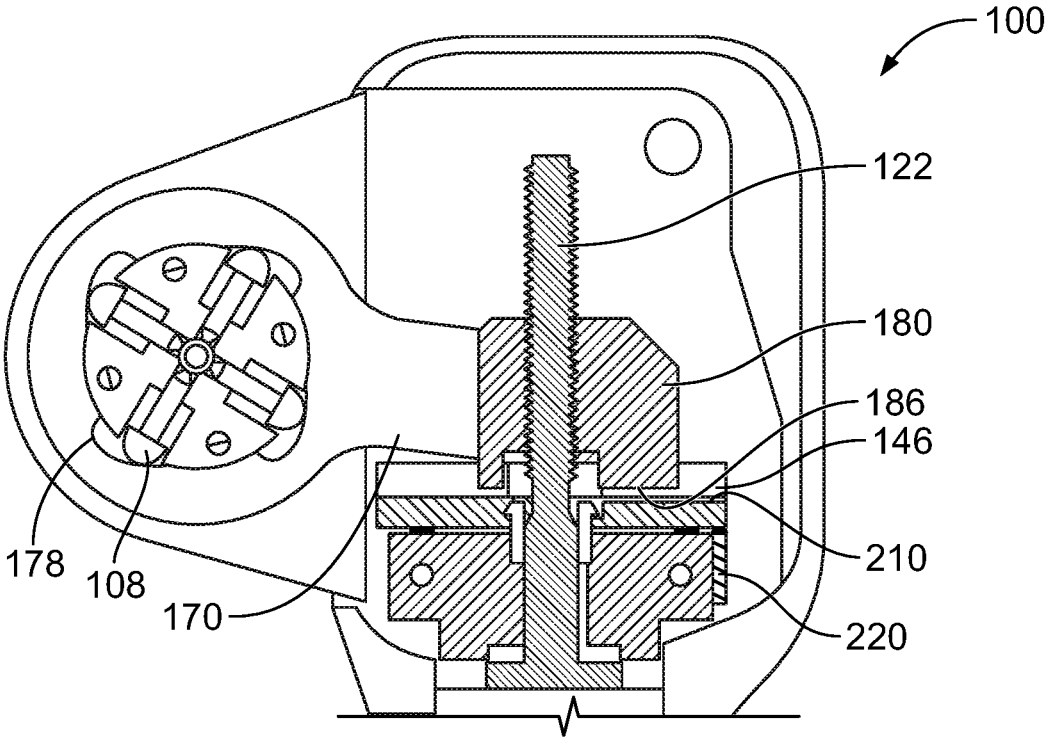
FIG. 5 is a side, partial sectional view of a portion of the 4-way indent tool showing the drive nut in the actuated position.

FIG. 4 is a side, partial sectional view of a portion of the 4-way indent tool 100 showing the drive nut 180 in the unactuated position. FIG. 5 is a side, partial sectional view of a portion of the 4-way indent tool 100 showing the drive nut 180 in the actuated position. The motor 116 is operated to rotate the drive screw 122 to move the drive nut 180 and the indenter actuator cam arm 170. The drive nut 180 is a mechanical linkage between the indenter actuator cam arm 170 and the drive screw 122 that converts rotating movement of the drive screw 122 to linear movement between the unactuated position and the actuated position. The drive nut 180 is moved along the drive stroke until the bottoming surfaces 186 bottom out against the bottoming surfaces 210 of the crimp height adjustment mechanism 146 at the bottom of the crimp stroke. The limit switch 220 stops and/or reverses movement of the drive nut 180 to the unactuated position. In the actuated position (FIG. 5), the indenter actuator cam arm 170 has been rotated such that the cam surfaces 178 drive the indenters 108 inward to crimp the terminal 102.

Figure 6:
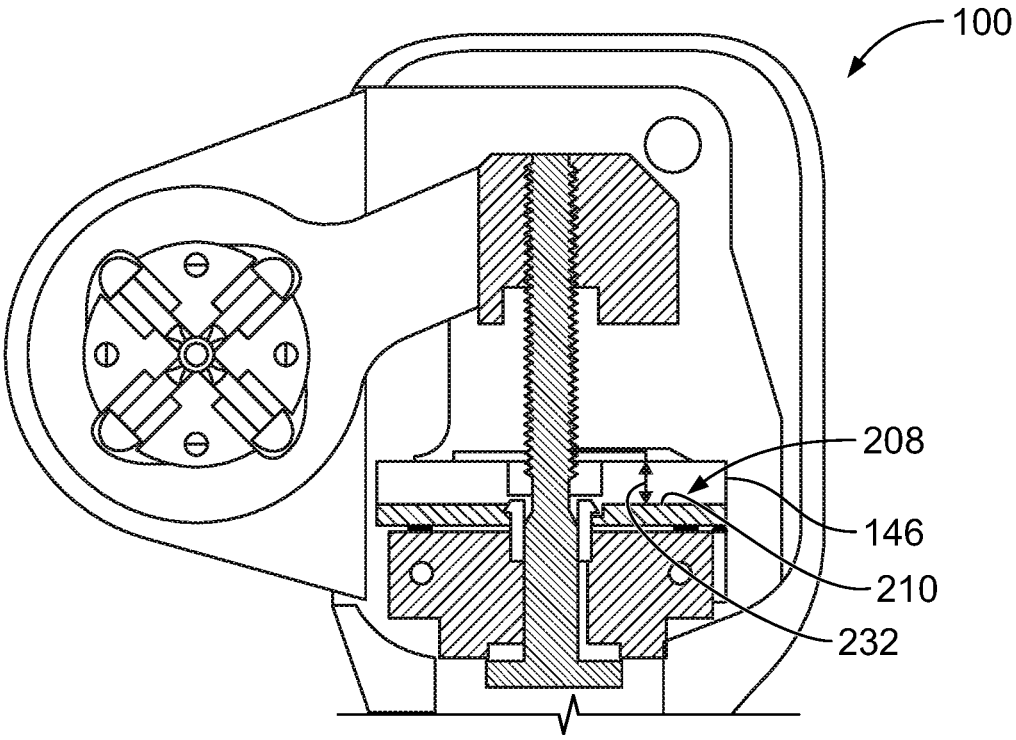
FIG. 6 is a side, partial sectional view of a portion of the 4-way indent tool showing a crimp height adjustment mechanism.

FIG. 6 is a side, partial sectional view of a portion of the 4-way indent tool 100 showing the crimp height adjustment mechanism 146 at a different position than the embodiment shown in FIG. 4. With additional reference back to FIG. 4, FIG. 4 shows the crimp height adjustment mechanism 146 in a first position having a first set of grooves 208 with the bottoming surfaces 210 at a first depth 230. FIG. 6 shows the crimp height adjustment mechanism 146 at a second position having a second set of the grooves 208 with the bottoming surfaces 210 at a second depth 232 greater than the first depth 230. As such, the bottoming surfaces 210 at the second position are at a different vertical height than at the first position, which changes the vertical height of the drive nut 180 at the actuated position.

Figure 7:
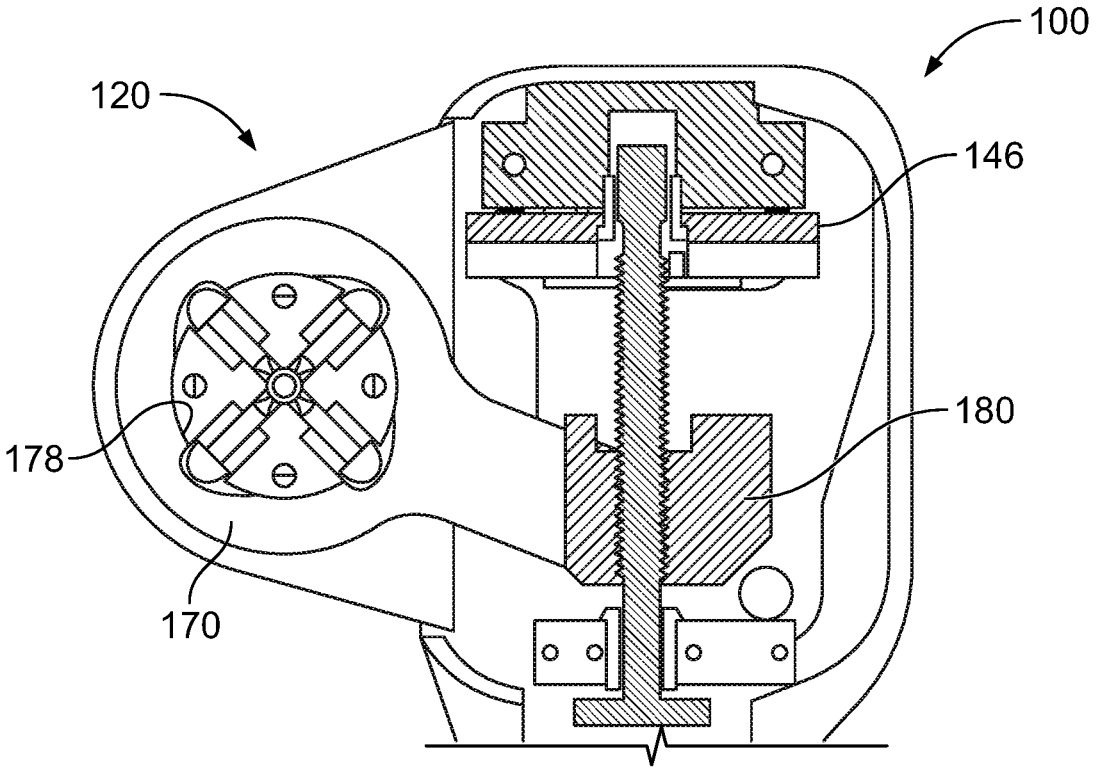
FIG. 7 is a side, partial sectional view of a portion of the 4-way indent tool in accordance with an exemplary embodiment.

FIG. 7 is a side, partial sectional view of a portion of the 4-way indent tool 100 showing the indenter assembly 120 arranged such that the drive nut 180 is driven upward, rather than downward, from the unactuated position to the actuated position. In the illustrated embodiment, the crimp height adjustment mechanism 146 is provided above the drive nut 180. The cam surfaces 178 on the indenter actuator cam arm 170 have a reverse orientation as compared to the embodiment shown in FIG. 4.

Figure 8:
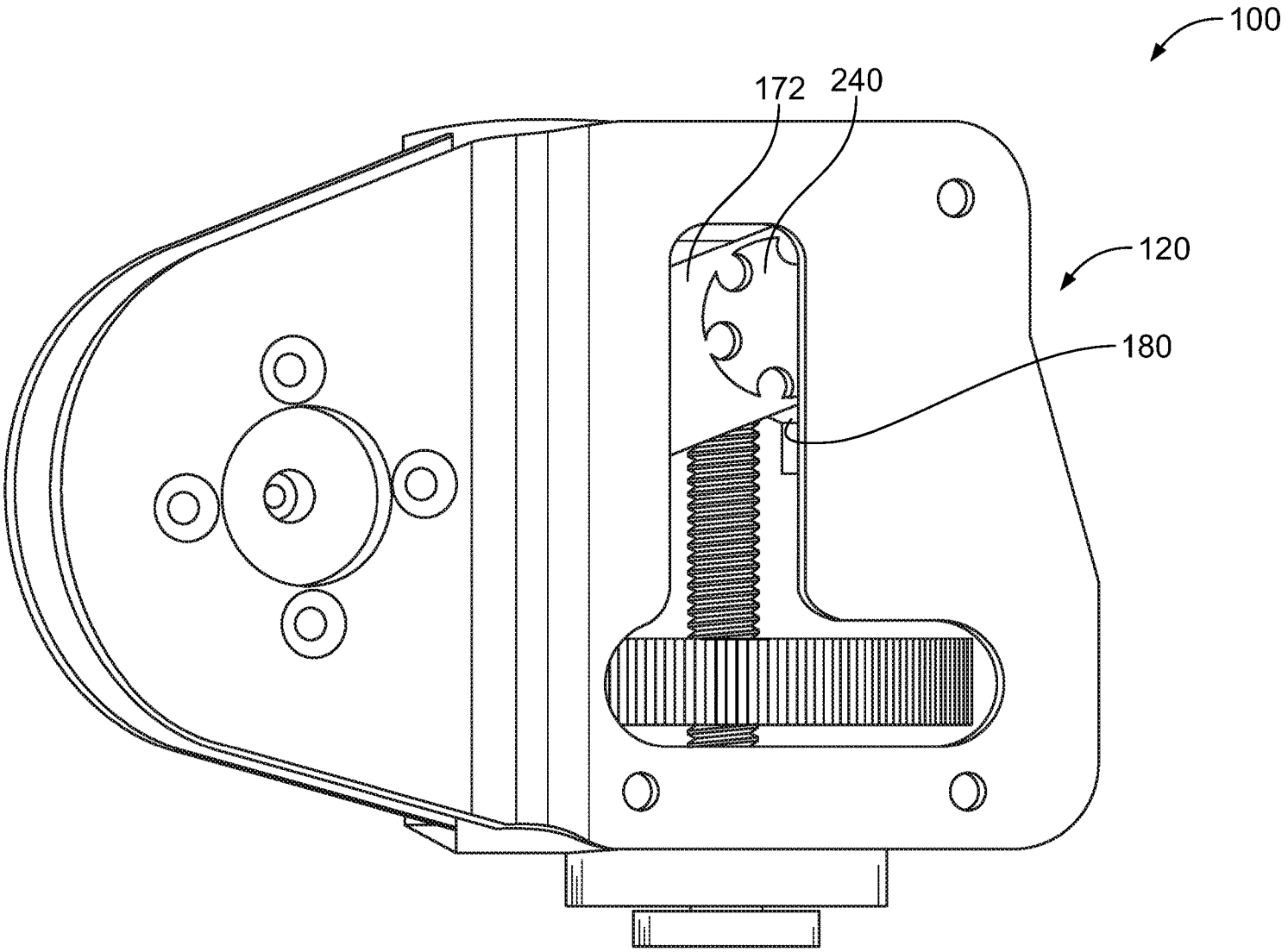
FIG. 8 is a perspective view of a portion of the 4-way indent tool in accordance with an exemplary embodiment.

FIG. 8 is a perspective view of a portion of the 4-way indent tool 100 showing the indenter assembly 120 with the cover 110 removed to illustrate the indenter assembly 120. The 4-way indent tool 100 includes a cam lever fine adjustment mechanism 240 coupled to the cam lever arm 172 and the drive nut 180 to change the relative position of the cam lever arm 172 with respect to the drive nut 180. Optionally, the adjustment mechanism 240 may be rotated to adjust the position of the cam lever arm 172 with respect to the drive nut 180. Adjustment of the adjustment mechanism 240 may adjust the position of the indenter actuator cam arm 170 when the drive nut 180 is in the unactuated position. As such, the actuated positions of the indenters 108 may be controlled or adjusted by adjusting the adjustment mechanism 240, such as to change the crimp or indenting height of the indenter assembly 120.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A 4-way indent tool comprising:

a cover having a base and a head, the base holding a motor driven by a power source, the head holding a drive screw operably coupled to the motor and being rotated by the motor when the motor is operated;

an indenter holder at the head, the indenter holder holding four indenters positioned orthogonally around a terminal opening configured to receive a terminal, the indenters being actuated to move relative to the terminal opening to crimp the terminal received in the terminal opening;

an indenter actuator cam arm positioned adjacent the indenter holder to operably engage the indenters, the indenter actuator cam arm having cam surfaces engaging the corresponding indenters to actuate the indenters, the indenter actuator cam arm having a cam lever arm; and a drive nut threadably coupled to the drive screw, the drive nut being moved linearly on the drive screw between an unactuated position and an actuated position, the indenter actuator cam arm being coupled to the drive nut and moving with the drive nut between the unactuated position and the actuated position to actuate the indenters.

2. The 4-way indent tool of claim 1, wherein the drive nut converts rotating movement of the drive screw to linear movement between the unactuated position and the actuated position.

3. The 4-way indent tool of claim 1, wherein the motor is an electric motor powered by a battery defining the power source in the base of the cover.

4. The 4-way indent tool of claim 1, wherein the head includes a cavity, the drive screw and the drive nut being positioned in the cavity and enclosed by the cover.

5. The 4-way indent tool of claim 1, wherein the head extends between a top and a bottom, the drive nut being driven downward along the drive screw between the unactuated position and the actuated position.

6. The 4-way indent tool of claim 1, further comprising an indenter actuator cam arm adjustment mechanism coupled to the cam lever arm and the drive nut to change a relative position of the cam lever arm with respect to the drive nut.

7. The 4-way indent tool of claim 1, further comprising a limit switch at the head being operably coupled to the motor to switch an operation of the motor, the limit switch being configured to be actuated by the drive nut when the drive nut is in the actuated position to activate the limit switch.

8. The 4-way indent tool of claim 1, further comprising a crimp height adjustment mechanism variably positionable relative to the head, the drive nut bottoming out against the crimp height adjustment mechanism in the actuated position, wherein the actuated position is variable and controlled by the position of the crimp height adjustment mechanism.

9. The 4-way indent tool of claim 8, wherein the drive nut is movable along a drive stroke between the unactuated position and the actuated position, a length of the drive stroke being variable and controlled based on the position of the crimp height adjustment mechanism.

10. The 4-way indent tool of claim 8, wherein the crimp height adjustment mechanism includes a first bottoming surface and a second bottoming surface at a different vertical height than the first bottoming surface, the crimp height adjustment mechanism being movable relative to the cover between a first position and a second position, the first bottoming surface being aligned with the drive nut and engaged by the drive nut at the actuated position when the crimp height adjustment mechanism is in the first position, the second bottoming surface being aligned with the drive nut and engaged by the drive nut at the actuated position when the crimp height adjustment mechanism is in the second position.

11. The 4-way indent tool of claim 10, wherein the drive nut includes a bottoming surface, the bottoming surface engaging the first bottoming surface when the crimp height adjustment mechanism is in the first position, the bottoming surface engaging the second bottoming surface when the crimp height adjustment mechanism is in the second position.

12. The 4-way indent tool of claim 10, wherein the crimp height adjustment mechanism includes a third bottoming surface at a different vertical height than the first bottoming surface and the second bottoming surface.

13. The 4-way indent tool of claim 8, wherein the crimp height adjustment mechanism is rotatably coupled to the cover.

14. The 4-way indent tool of claim 8, wherein the crimp height adjustment mechanism includes a bore passing therethrough, the drive shaft passing through the bore.

15. The 4-way indent tool of claim 8, wherein the crimp height adjustment mechanism includes a ring-shaped body having a plurality of grooves, the grooves having different depths, the drive nut including a bottoming surface configured to be received in the corresponding grooves.

16. A 4-way indent tool comprising:

a cover having a base and a head, the base holding a motor driven by a power source, the cover holding a drive screw operably coupled to the motor and being rotated by the motor when the motor is operated;

a crimp height adjustment mechanism variably positionable relative to the head, an indenter holder at the head, the indenter holder holding four indenters positioned orthogonally around a terminal opening configured to receive a terminal, the indenters being actuated to move relative to the terminal opening to crimp the terminal received in the terminal opening;

an indenter actuator cam arm positioned adjacent the indenter holder to operably engage the indenters, the indenter actuator cam arm having cam surfaces engaging the corresponding indenters to actuate the indenters, the indenter actuator cam arm having a cam lever arm; and a drive nut threadably coupled to the drive screw, the indenter actuator cam arm being coupled to the drive nut and movable with the drive nut to actuate the indenters, the drive nut being driven on the drive screw between an unactuated position and an actuated position, the drive nut bottoming out against the crimp height adjustment mechanism in the actuated position, wherein the actuated position is variable and controlled by the position of the crimp height adjustment mechanism.

17. The 4-way indent tool of claim 16, wherein the drive nut is movable along a drive stroke between the unactuated position and the actuated position, a length of the drive stroke being variable and controlled based on the position of the crimp height adjustment mechanism.

18. The 4-way indent tool of claim 17, wherein the crimp height adjustment mechanism includes a first bottoming surface and a second bottoming surface and a different vertical height than the first bottoming surface, the crimp height adjustment mechanism being movable relative to the cover between a first position and a second position, the first bottoming surface being aligned with the drive nut and engaged by the drive nut at the actuated position when the crimp height adjustment mechanism is in the first position, the second bottoming surface being aligned with the drive nut and engaged by the drive nut at the actuated position when the crimp height adjustment mechanism is in the second position.

19. The 4-way indent tool of claim 17, wherein the drive nut includes a bottoming surface, the bottoming surface engaging the first bottoming surface when the crimp height adjustment mechanism is in the first position, the bottoming surface engaging the second bottoming surface when the crimp height adjustment mechanism is in the second position.

20. A 4-way indent tool comprising:

a cover having a base and a head, the base holding a motor driven by a power source, the cover holding a drive screw operably coupled to the motor and being rotated by the motor when the motor is operated;

a crimp height adjustment mechanism variably positionable relative to the head, an indenter holder at the head, the indenter holder holding four indenters positioned orthogonally around a terminal opening configured to receive a terminal, the indenters being actuated to move relative to the terminal opening to crimp the terminal received in the terminal opening;

a indenter actuator cam arm positioned adjacent the indenter holder to operably engage the indenters, the indenter actuator cam arm having cam surfaces engaging the corresponding indenters to actuate the indenters, the indenter actuator cam arm having a cam lever arm; and a drive nut threadably coupled to the drive screw, the indenter actuator cam arm being coupled to the drive nut and movable with the drive nut to actuate the indenters, the drive nut being driven on the drive screw between an unactuated position and an actuated position, the drive nut bottoming out against the crimp height adjustment mechanism in the actuated position; and a limit switch at the head being operably coupled to the motor to switch an operation of the motor, the limit switch being positioned adjacent the crimp height adjustment mechanism, wherein the crimp height adjustment mechanism is forced into the limit switch when the drive nut bottoms out against the crimp height adjustment mechanism to activate the limit switch.

* * * * *